US005819829A

United States Patent [19]

Matthews

[11] Patent Number: 5,819,829

[45] Date of Patent: Oct. 13, 1998

[54] GOLF BAG RAIN HOOD

[76] Inventor: James F. Matthews, 7 Dellwood Pl., Binghamton, N.Y. 13903

[21] Appl. No.: 788,922

[22] Filed: Jan. 24, 1997

[51] Int. Cl.[6] ..... B65D 65/02

[52] U.S. Cl. ..... 150/159; 383/3; 206/315.4

[58] Field of Search ..... 206/315.5, 315.6, 206/522; 383/3; 150/160, 159

[56] References Cited

U.S. PATENT DOCUMENTS

| | | | |
|---|---|---|---|
| 3,754,587 | 8/1973 | Rainieri | 150/159 |
| 3,977,451 | 8/1976 | Duba | 150/159 X |
| 4,234,025 | 11/1980 | Berge | 150/160 X |
| 4,384,603 | 5/1983 | Tyrer et al. | 206/522 X |
| 5,131,442 | 7/1992 | Bevier | 150/159 |
| 5,383,505 | 1/1995 | Cordasco, Jr. | 150/159 |
| 5,421,454 | 6/1995 | Chern | 206/522 X |
| 5,490,594 | 2/1996 | Rupe | 150/159 X |
| 5,624,035 | 4/1997 | Kim | 206/522 |

*Primary Examiner*—Allan N. Shoap
*Assistant Examiner*—Tri M. Mai
*Attorney, Agent, or Firm*—Salzman & Levy

[57] ABSTRACT

The present invention is a hood or cover for golf bags, which features pneumatic, air-filled tubes and/or stiffeners, used as a frame or skeleton, to produce a finite, yet compliant physical shape. The inventive rain hood utilizes a hinged top to accommodate the full range of club sizes and yet make removal and replacement quick, easy and positive. The hood or cover also shields the remaining clubs while removing or replacing any one club. A universal attachment system accommodates almost all golf bags commonly used today. The attachment mechanism is a one-step cinch system which is infinitely adjustable from the smallest to the largest of currently-used golf bags. Once attached, the rain hood inflates quickly to its rigid state with either a built-in hand pump or an auxiliary pressurized hand-held inflator.

8 Claims, 11 Drawing Sheets

GOLF BAG RAIN HOOD

This application claims the benefit of U.S. Provisional application Ser. No. 60/010,766, filed Jan. 26, 1996.

FIELD OF THE INVENTION

The present invention relates to structures for covering and protecting articles, such as golf clubs, from weather or hostile environments and, more particularly, to plastic covers or structures, the frames of which are pneumatic, air-filled tubes.

BACKGROUND OF THE INVENTION

Golfers frequently encounter rainy weather while playing. This creates considerable problems. It is very important to keep golf clubs dry, since water on the grip area thereof becomes problematical or even dangerous, when swinging the club. It is well understood that wet grips result in a serious loss in distance and direction of the mis-hit golf ball. A golfer's confidence, in turn, is negatively influenced due to the feeling of not having a firm hold and control of the club. Most golfers carry umbrellas and towels to help keep themselves dry. In fact, many golf bags are even sold with a cover to help keep the clubs dry.

To date, no rain hood designs address the practical problems encountered when using clubs in rainy weather. Most covers will keep the clubs reasonably dry if the clubs are not being taken out of, and returned to, the bag, but fail badly during actual use. Such conventional covers generally attach to the top of the golf bag with snaps or belts, and have little or no provision for removing and replacing a club, as is necessary when playing a round of golf. Standard covers or hoods which attempt to solve these problems typically utilize elastic openings, zippers or snaps to open and close an opening where a club can be removed and replaced. All are cumbersome and result in wet clubs when removing and replacing them, since the fabric is loose, holds water, and drags on the club. The hoods have little or no support. Thus, water runs onto the shaft and grip during transfer.

SUMMARY OF THE INVENTION

It would be advantageous to provide a cover or hood for golf bags that includes significant structural support of the hood or cover to avoid pooling and collection of water.

It would also be advantageous to provide such a cover or hood that would permit control of the opening for withdrawing and replacing a club.

It would further be advantageous to provide such a cover or hood that would allow a player to minimize the time necessary to withdraw and/or replace a club, so as to reduce exposure of both club and hands.

The present invention utilizes pneumatic, air-filled tubes and/or stiffeners as a frame or skeleton to produce a finite, yet compliant physical shape. This design requires absolute minimal contact with both the clubs and one's hands during operation. All tubes and/or stiffeners are designed so that they support and retain the desired points which are required for the opening/closing features desired. The inventive rain hood utilizes a hinged top to accommodate the full range of club sizes and yet make removal and replacement quick, easy and positive.

The design of the top is unique also in that it shields the remaining clubs while removing or replacing any one club. The rain hood folds into a compact size and is easily stored in the pouches of all commercial golf bags. It is flexible and will conform to most conventionally-shaped golf bag pockets. When withdrawn for use, the hood can be unfolded quickly.

A unique, universal attachment system accommodates almost all golf bags commonly used today. The attachment means is a one-step cinch system which is infinitely adjustable from the smallest to the largest of currently-used golf bags. Once attached, the rain hood inflates quickly to its rigid state with either a built-in hand pump or an auxiliary pressurized hand-held inflator. Likewise, deflation takes very little time, as does folding and storing. Other embodiments, utilizing snap-open, foldable and storable stiffeners can also be used and are considered to be within the scope of this invention.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

The present invention is a hood or cover for golf bags, which utilizes pneumatic, air-filled tubes and/or stiffeners as a frame or skeleton to give the product a finite yet compliant physical shape. The rain hood utilizes a hinged top which accommodates the full range of club sizes. The cover also shields the remaining clubs while removing or replacing any one club. The rain hood folds into a compact size and is easily stored in the pouches of all current golf bags. It is flexible and will conform to most conventionally-shaped golf bag pockets. A universal attachment system accommodates almost all golf bags commonly used today. For the sake of clarity, identical reference numbers refer to the same elements in the various embodiments of the invention.

Figure 1B:
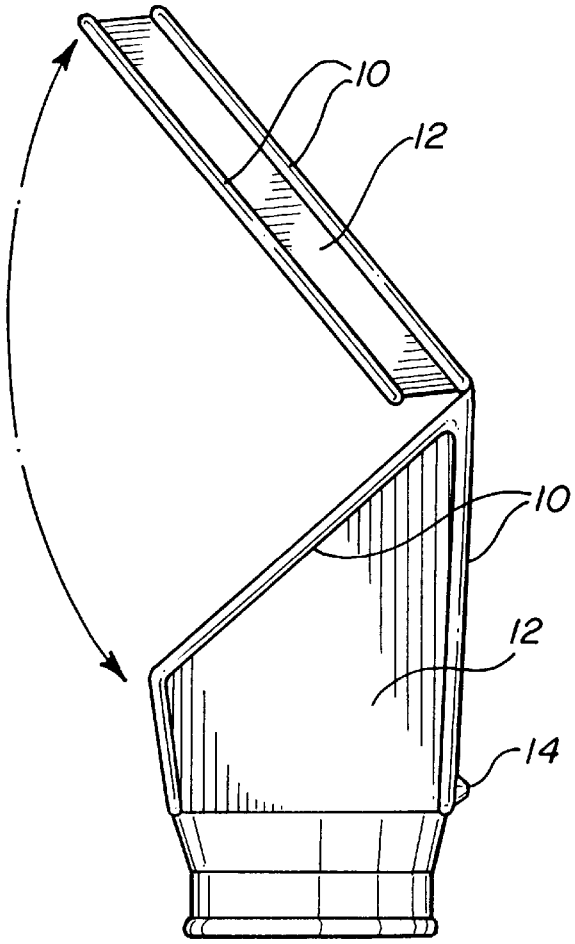
FIGS. 1*a* and 1*b* are perspective and side views, respectively, of the hood or cover of the present invention, mounted on a golf bag, in an open position.
Figure 1A:
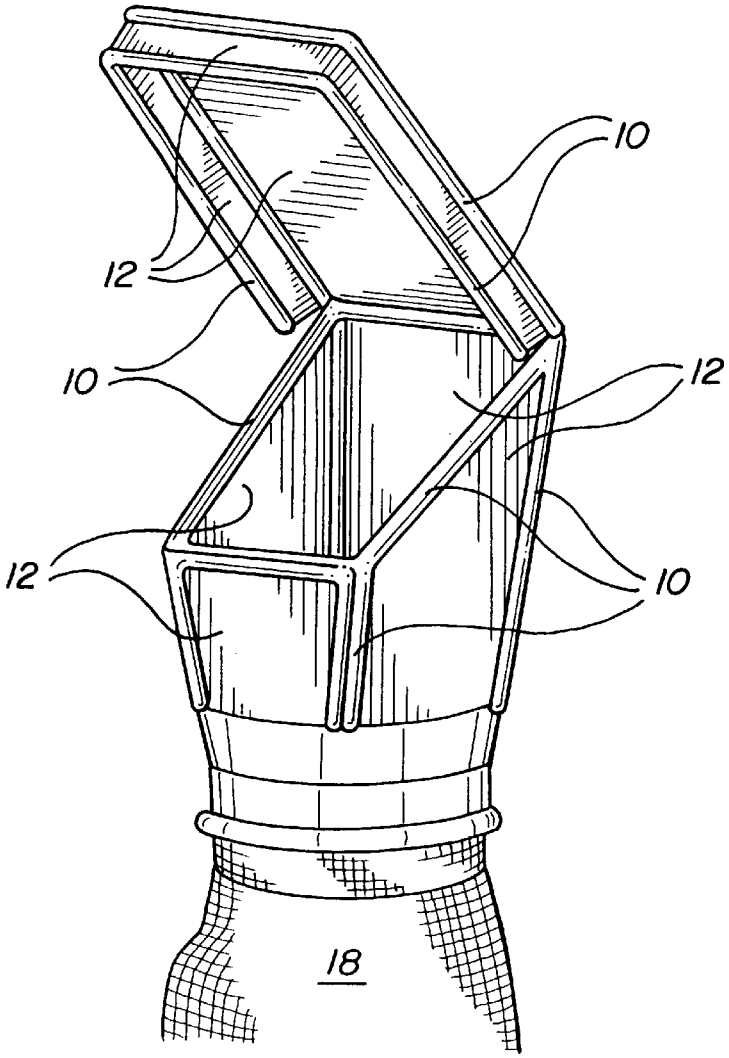

Referring now to the FIGS. 1*a* and 1*b*, there is shown a first embodiment of the invention. A pneumatic frame or skeleton 10 is fabricated, to which is attached sheets of plastic 12 to form the overall hood or cover. The frame or skeleton 10 and method of manufacture are discussed in greater detail hereinbelow. The plastic sheet material used, in the preferred embodiment, is polyurethane in a thickness of between approximately 0.005 and 0.015 inches.

A standard fill valve 14, such as is found in air mattresses, floats, etc., is used to inflate and deflate the skeleton 10 with air. An external air pump or an optional built-in hand pump, not shown, can be used for this purpose.

The frame or skeleton 10 is actually a network of connected hollow tubes fabricated of Shore 65A polyurethane, between approximately 0.005 and 0.015 inches thick, and approximately between ⅛" and ⅜" in diameter. The tubes 10 are shown in greater detail in FIG. 12. Tubes 10 are sealed with a 25 kw radio frequency welding machine.

The tube 10 connecting the upper portion of the hood to its body also acts as a flexible hinge, so that the upper portion can be swung up with one hand, much as a visor is pivoted from a welder's helmet. The player can raise the upper portion with one hand, while removing or replacing a golf club with the other hand.

An adjustable fastening device 16, such as a pair of Velcro® strips, is used to fasten the base of the hood securely to the golf bag 18, which holds the golf clubs 20, protected from the elements. The fastening or attaching mechanism can be a one-step cinch system, which is infinitely adjustable from the smallest to the largest of the currently-used golf bags 18.

Once attached, the rain hood can be inflated quickly to its rigid state with either the aforementioned built-in hand pump or an auxiliary pressurized hand-held inflator, not shown. Likewise, deflation takes very little time, as does folding and storing.

Figure 2:
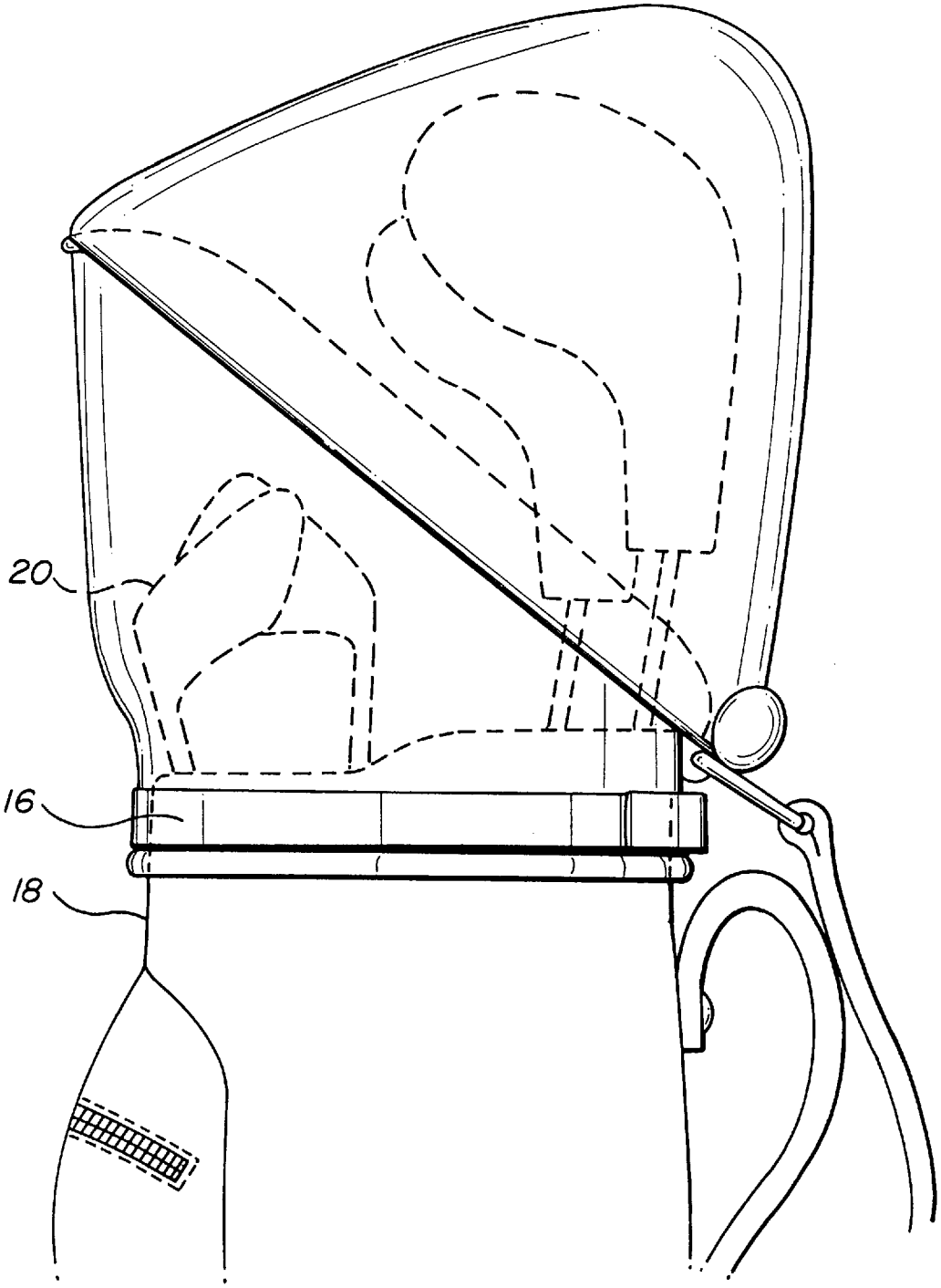
FIG. 2 is a side view of an alternate embodiment of a cover in accordance with the present invention.
Figure 3:
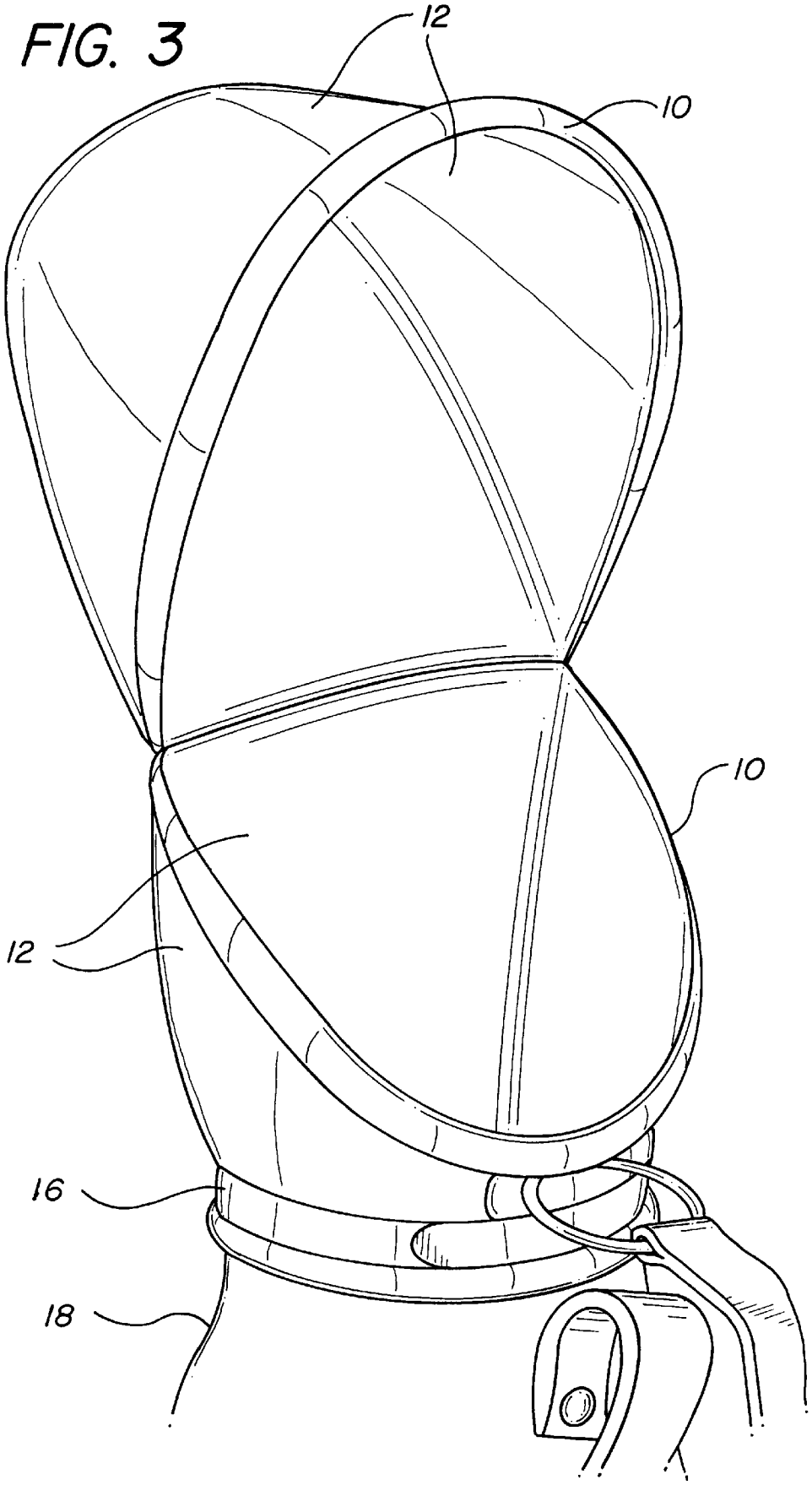
FIG. 3 is a perspective view of an alternate embodiment of the present invention.

Referring now to FIGS. 2 and 3, there are shown, respectively, side plan and perspective views of a first alternate embodiment of the invention. Pneumatic frame or skeleton 10 is covered with sheets of plastic 12. The inventive hood is attached to golf bag 18 by means of an adjustable fastening device 16.

Figure 4:
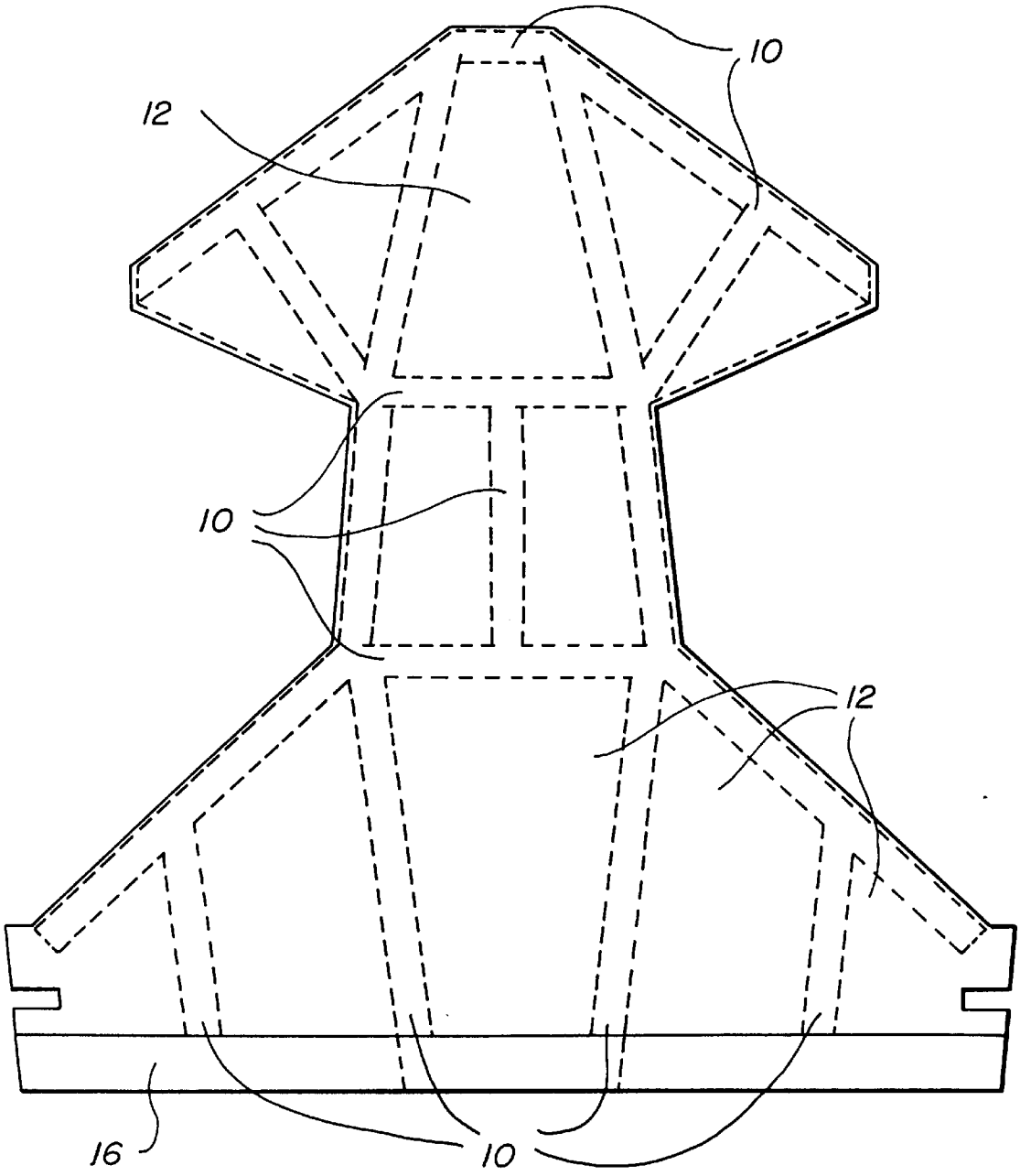
FIG. 4 is a plan view of the preferred embodiment of the present invention in its two-dimensional, uninflated state.

Referring now to FIG. 4, there is shown a top plan view of a second alternate embodiment of the invention in its uniflated stated. Pneumatic frame or skeleton 10 is covered with sheets of plastic 12. The adjustable fastening device 16 is also shown.

Figure 5:
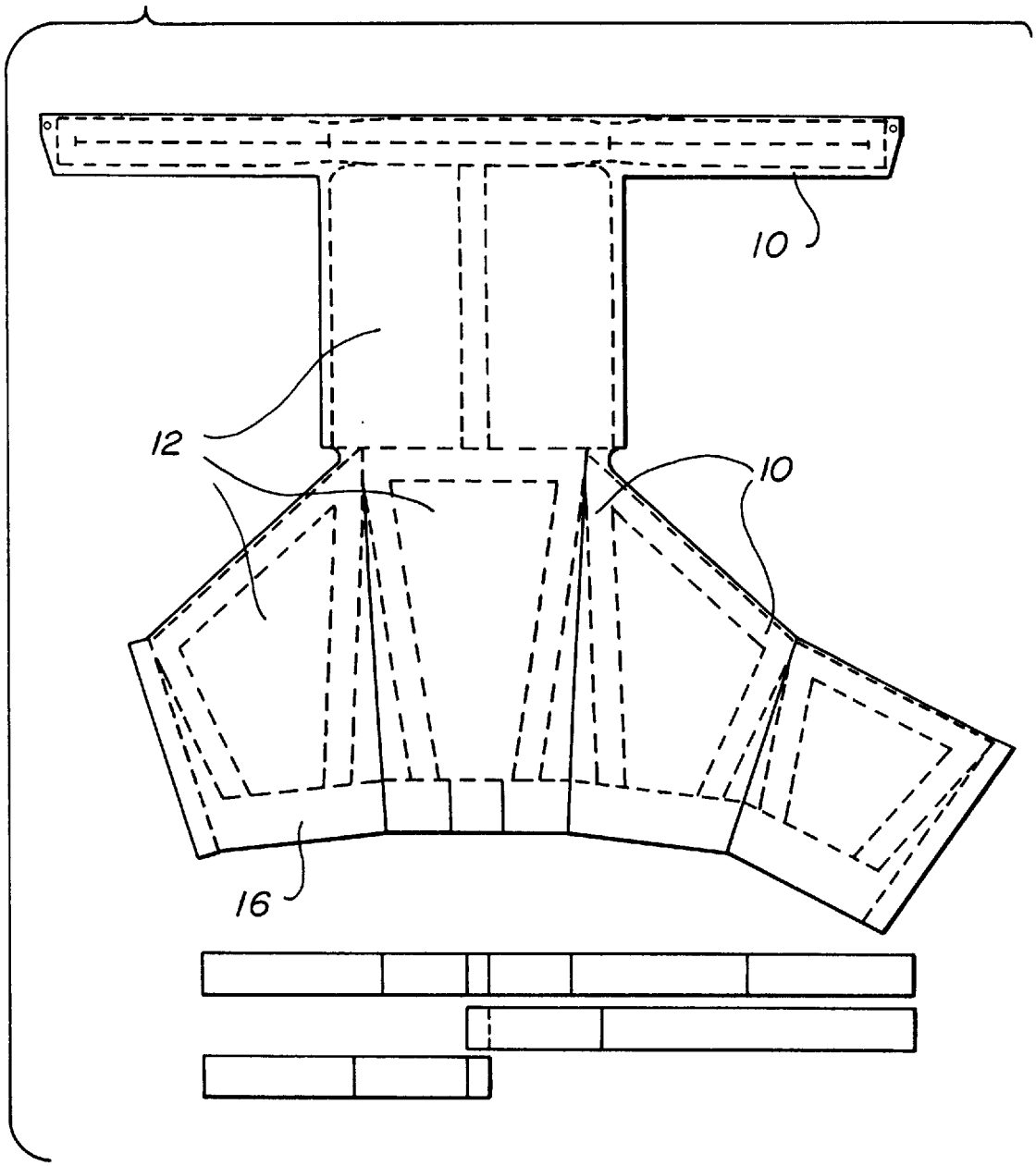
FIG. 5 is a plan view of another embodiment of the present invention in its two-dimensional, uninflated state.
Figure 6:
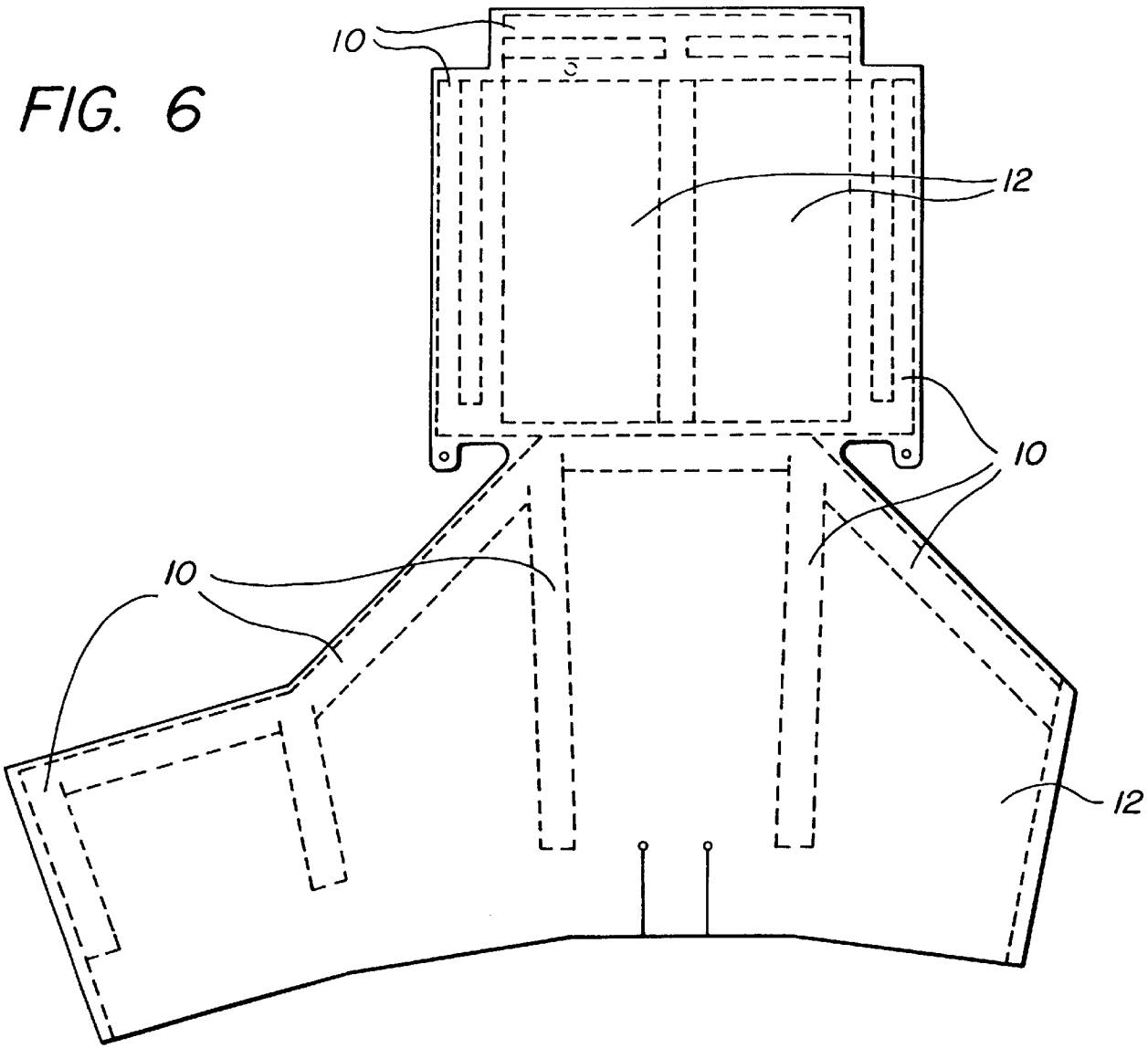
FIG. 6 is a plan view of yet another embodiment of the present invention in its two-dimensional, uninflated state.
Figure 7:
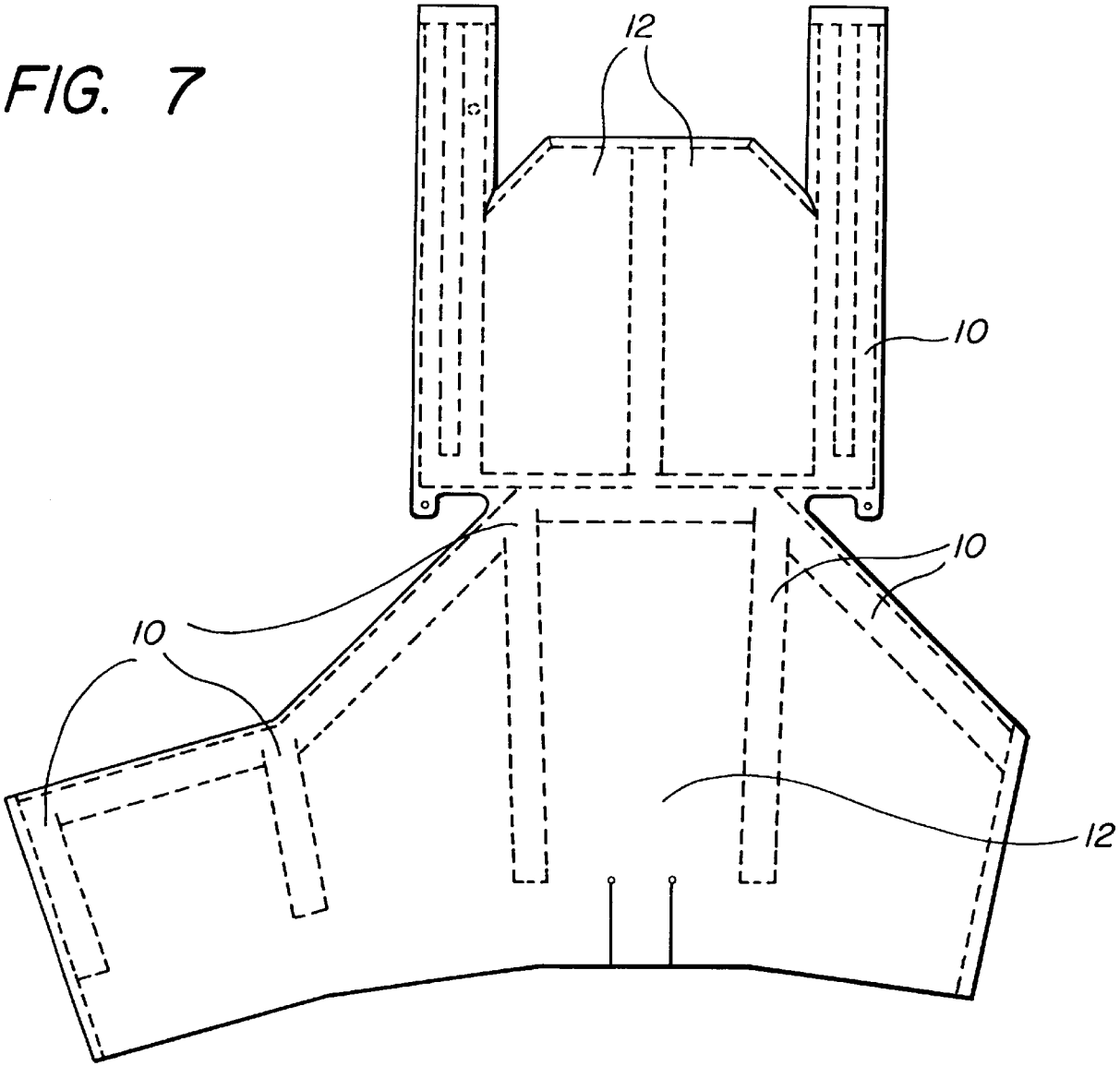
FIG. 7 is a plan view of yet another embodiment of the present invention in its two-dimensional, uninflated state.
Figure 8:
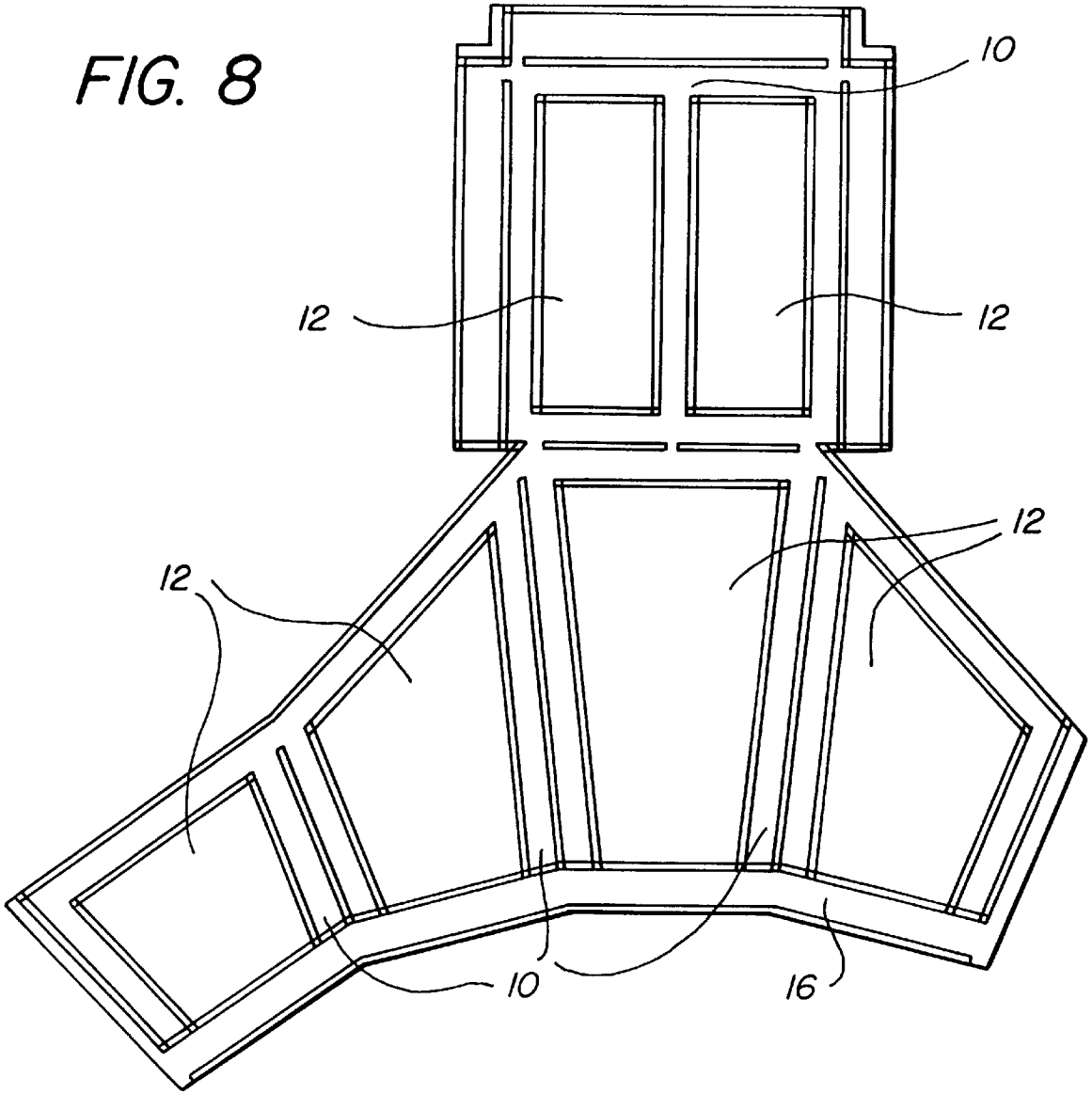
FIG. 8 is a plan view of yet another embodiment of the present invention in its two-dimensional, uninflated state.
Figure 9:
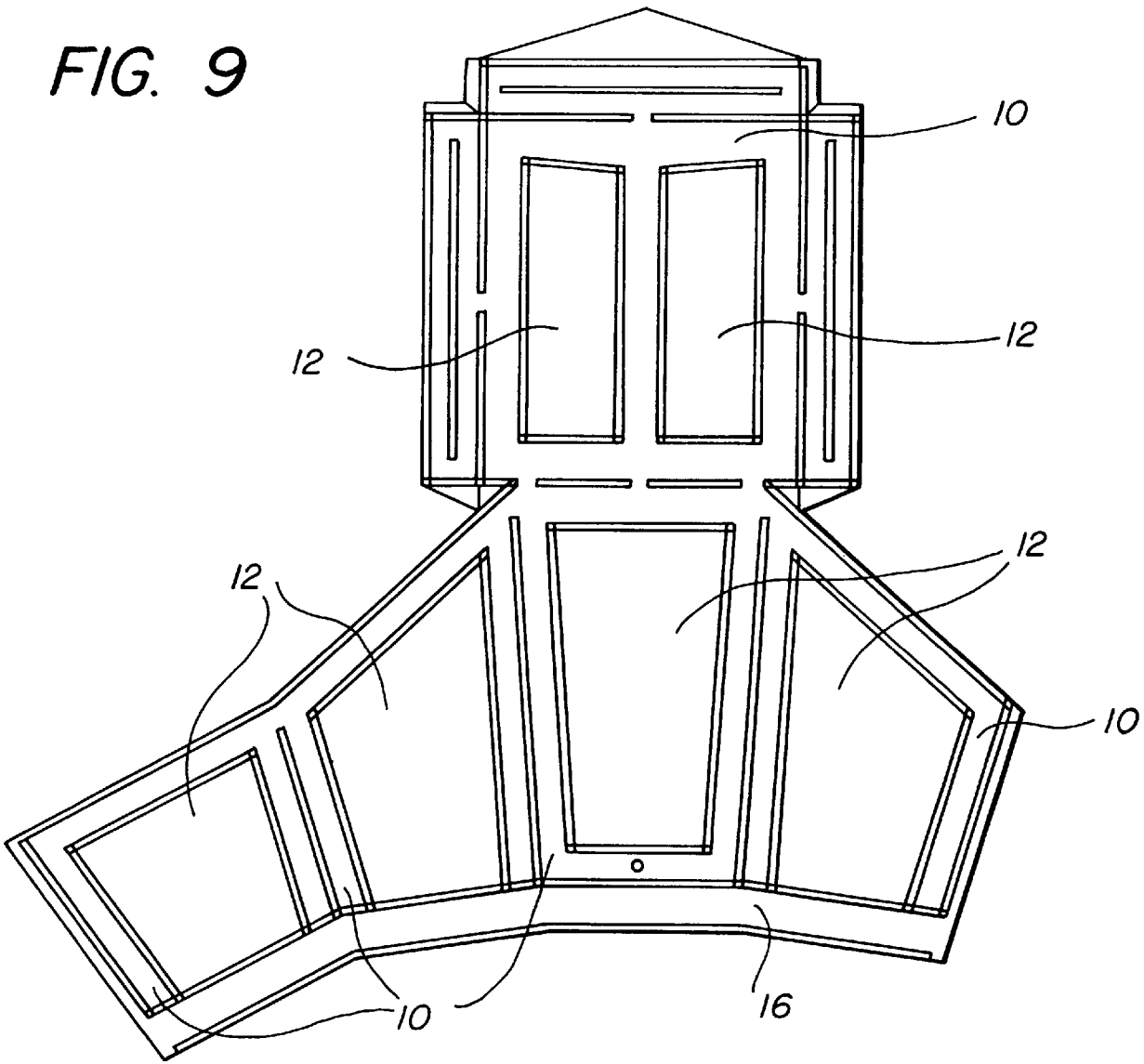
FIG. 9 is a plan view of yet another embodiment of the present invention in its two-dimensional, uninflated state.
Figure 10:
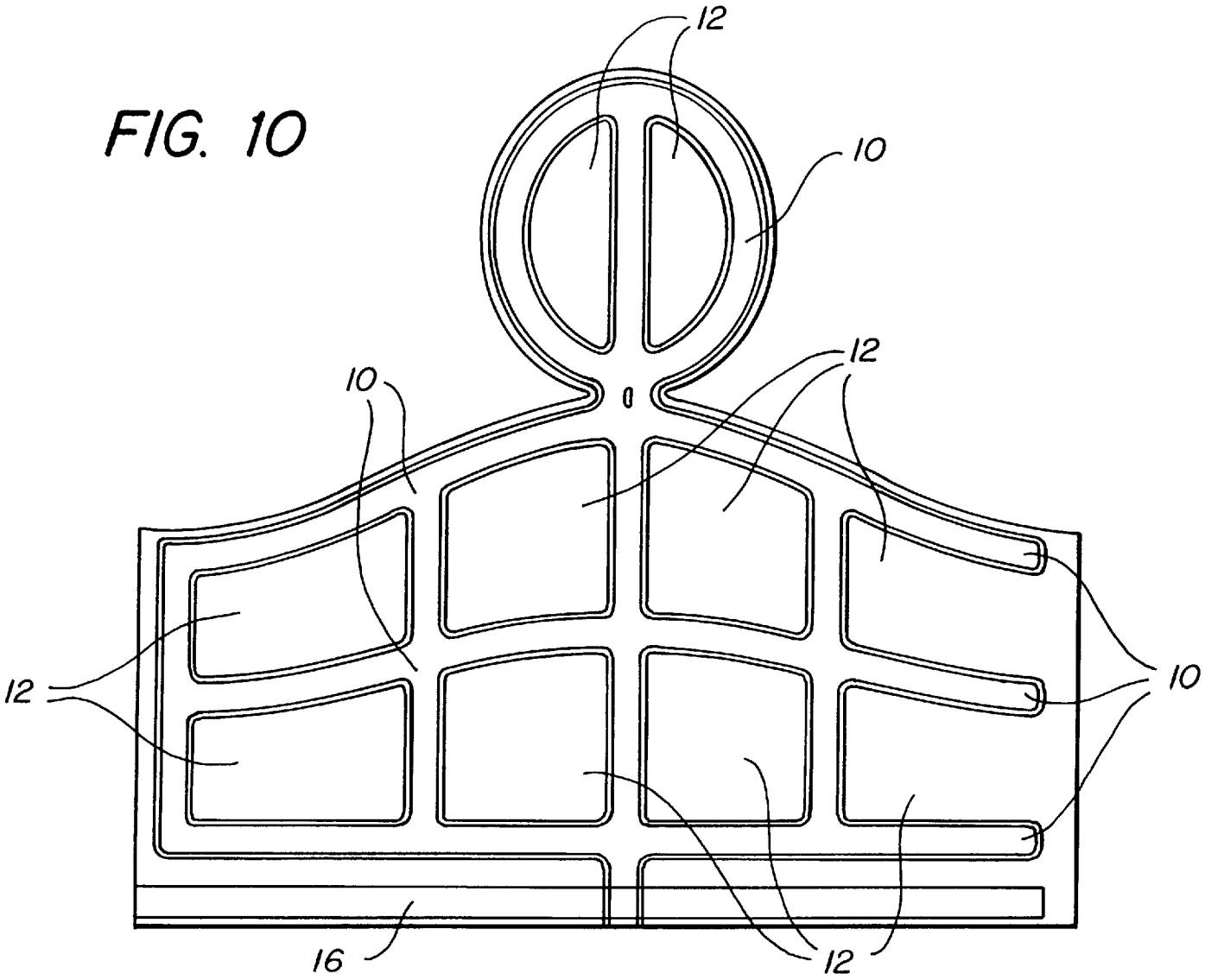
FIG. 10 is a plan view of another embodiment of the present invention, in which is shown the pneumatic, air tubes forming the skeleton thereof.

Referring now to FIG. 5, there is shown a top plan view of the preferred embodiment of the invention. Pneumatic frame or skeleton 10 is covered with sheets of plastic 12. The adjustable fastening device 16 is also shown, Referring now to FIGS. 6–10, there are shown top plan views of third, fourth, fifth, sixth and seventh alternate embodiments of the invention. Pneumatic frames or skeletons 10 are covered with sheets of plastic 12. The adjustable fastening devices 16 are also shown.

Figure 11:
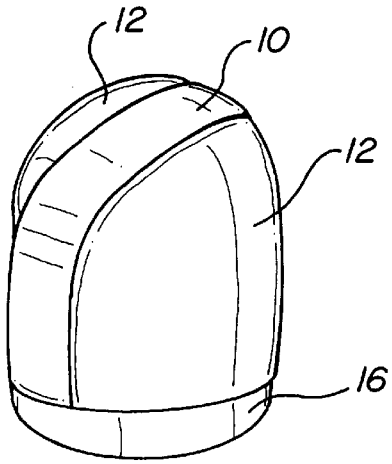
FIGS. 11, 11*a*, and 11*b* are respectively perspective, front, and top views of another embodiment of the present invention, depicting two separately-pivotable upper portions of the cover.
Figure 11A:
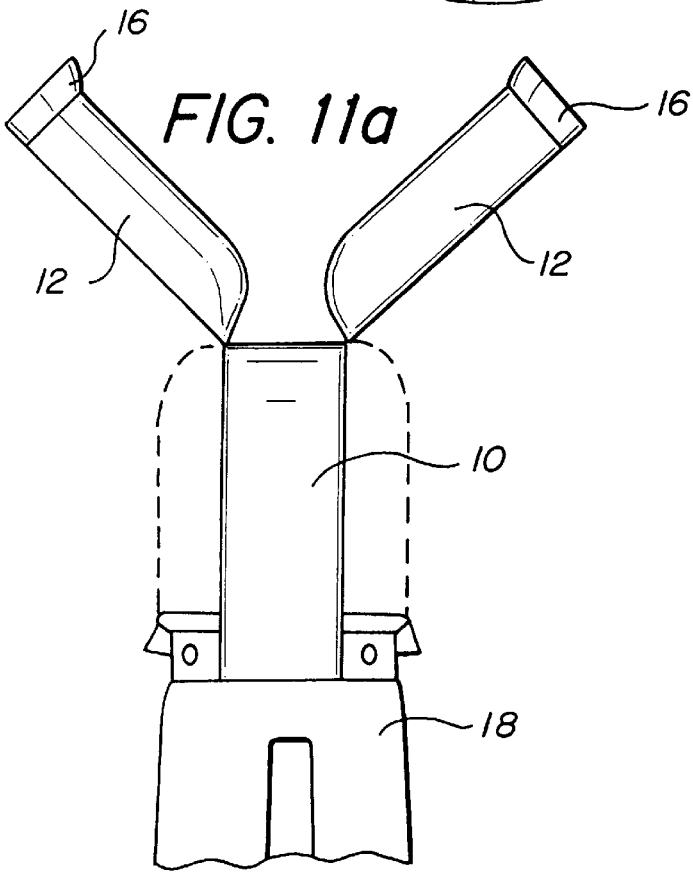
Figure 11B:
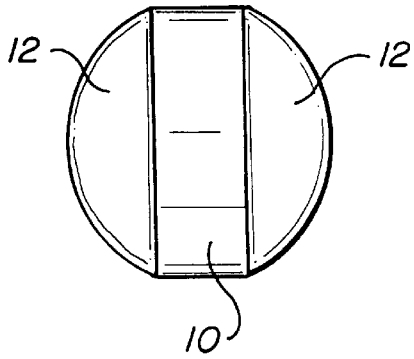

Referring now to FIGS. 11, 11*a* and 11*b*, there are shown perspective, front plan and top plan views, respectively, of an eighth, alternate embodiment of the present invention. Pneumatic frame or skeleton 10 is covered with sheets of plastic 12. The adjustable fastening device 16 is also shown.

Figure 12:
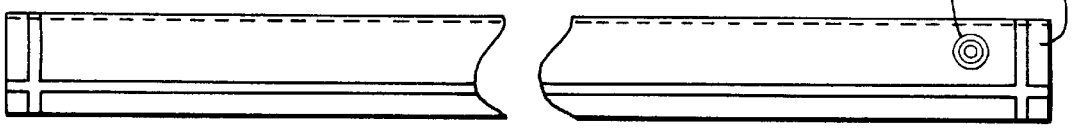
FIG. 12 is an enlarged view of a section of air tube skeleton for use in accordance with the present invention.

Referring now to FIG. 12, there is shown an enlarged view of an air tube 10 for use in accordance with the present invention. A standard fill valve 14 used for inflating or deflating the structure is shown.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A cover for a golf bag, comprising:

a) a skeleton of interconnected hollow tubes forming an upper portion and a body portion of a cover for said golf bag; and b) means operatively connected to said skeleton for filling said hollow tubes with gas to inflate same, said skeleton initially being substantially flexible in an uninflated state so that it can be folded and stored, but becoming substantially rigid in an inflated state, at least one of said tubes forming a hinge between said upper portion and said body portion of said cover, wherein a weather seal is formed between said upper portion and said body portion when said upper portion is closed with respect to said body portion about said hinge.

2. The cover in accordance with claim 2, wherein said skeleton of interconnected hollow tubes is filled with air.

3. The cover in accordance with claim 2, wherein said cover comprises polyurethane.

4. The cover in accordance with claim 3, wherein said skeleton of interconnected hollow tubes comprises polyurethane.

5. The cover in accordance with claim 3 or 4, wherein said polyurethane is substantially between 0.005 and 0.015 inches thick.

6. The cover in accordance with claim 1, further comprising:

c) attachment means operatively connected to said body portion of said cover for fastening said cover to a golf bag.

7. The cover in accordance with claim 6, wherein said attachment means comprises adjustment means for attachment about a mouth portion of different golf bags.

8. The cover in accordance with claim 7, wherein said attachment means comprises loop and hook fastener strips.

* * * * *